US007240861B2

(12) United States Patent
Zhu et al.

(10) Patent No.: US 7,240,861 B2
(45) Date of Patent: Jul. 10, 2007

(54) METHOD AND APPARATUS FOR DISPENSING PAINT POWDERS FOR POWDER COATINGS

(75) Inventors: Jesse Zhu, London (CA); Hui Zhang, London (CA)

(73) Assignee: The University of Western Ontario, London (CA)

( * ) Notice: Subject to any disclaimer, the term of this patent is extended or adjusted under 35 U.S.C. 154(b) by 0 days.

(21) Appl. No.: 10/638,425

(22) Filed: Aug. 12, 2003

(65) Prior Publication Data

US 2005/0035229 A1 Feb. 17, 2005

(51) Int. Cl.

| | |
|---|---|
| ***B05B 5/00*** | (2006.01) |
| ***B05B 5/53*** | (2006.01) |
| ***B05B 5/03*** | (2006.01) |
| ***H05F 3/00*** | (2006.01) |

(52) U.S. Cl. ..... 239/690; 239/691; 239/704; 239/706; 239/708; 361/226; 361/227

(58) Field of Classification Search ..... 239/690, 239/691, 704, 706, 708, 690.1, 692, 104, 239/106; 361/226, 227

See application file for complete search history.

(56) References Cited

U.S. PATENT DOCUMENTS

| | | | | |
|---|---|---|---|---|
| 3,698,635 | A * | 10/1972 | Sickles | 239/3 |
| 3,735,925 | A * | 5/1973 | Benedek et al. | 239/704 |
| 4,135,667 | A * | 1/1979 | Benedek et al. | 239/697 |
| 4,227,652 | A * | 10/1980 | Itoh | 239/706 |
| 4,228,961 | A | 10/1980 | Itoh | |
| 4,747,546 | A * | 5/1988 | Talacko | 239/707 |
| 4,772,982 | A * | 9/1988 | Nagasaka | 361/227 |
| 4,805,069 | A * | 2/1989 | Nagasaka et al. | 361/226 |
| 5,022,590 | A | 6/1991 | Buschor | |
| 5,720,436 | A * | 2/1998 | Buschor | 239/706 |
| 6,254,684 | B1 | 7/2001 | Borner et al. | |
| 6,274,202 | B1 | 8/2001 | Campbell | |

FOREIGN PATENT DOCUMENTS

| | | |
|---|---|---|
| DE | 2722100 | 11/1978 |
| EP | 0237249 | 6/1993 |
| GB | 2029271 | 3/1980 |

* cited by examiner

*Primary Examiner*—Joseph A. Kaufman
*Assistant Examiner*—Darren Gorman
(74) *Attorney, Agent, or Firm*—Lynn C. Schumacher; Hill & Schumacher

(57) ABSTRACT

A corona charge spray gun for dispensing powders for powder coatings. The spray gun includes a housing defining a chamber terminating in an outlet passageway. A high voltage electrode is mounted in the chamber spaced upstream of the outlet passageway and a ground electrode is mounted in the chamber spaced upstream from the high voltage electrode. The ground electrode is selected to have a surface area sufficiently larger than the surface area of the high voltage electrode in order to allow high voltages to be applied to the high voltage electrode without arch discharging occurring in the chamber. An inlet opens into the chamber for conducting a powder-gas mixture into the chamber and the electrodes receive cleaning gases for avoiding powder deposits on the electrodes.

8 Claims, 8 Drawing Sheets

METHOD AND APPARATUS FOR DISPENSING PAINT POWDERS FOR POWDER COATINGS

BACKGROUND OF THE INVENTION

1. Field of Invention

The present invention relates to a method and an apparatus for dispensing paint powders for powder coatings, and more particularly, the present invention relates to a corona charge spray gun for dispensing paint powders for powder coatings.

2. Description of the Related Art

Electrostatic powder coating is a method of surface finishing for metals or other materials in which a paint layer is applied in a dry powder form without the use of solvents. The powder, usually having powder particles with a mean size of about 30-60 microns and composed of a resin, pigments, flow agents and curing agents etc., is fluidized in a hopper and pneumatically transported to a spray gun through a plastic or rubber hose. The powder is then sprayed out the exit passageway of the gun whereupon it is positively or negatively charged and is attracted to a grounded work-piece, whereupon if forms a uniform powder layer. The work-piece covered with powder paint is then transferred to an oven where the powder layer melts and certain chemical reactions occur to form a smooth film of paint.

The spray gun can be a corona charge gun which is most widely used in the coating industry, or a tribo charge gun which occupies only a small fraction of the total market share. Conventional corona charge spray guns have a configuration similar to that shown in FIG. 1*a* which includes a powder-air mixture conduit, a high-voltage needle-like electrode located at the gun tip and a powder diffuser. Another typical configuration includes a powder-air mixture conduit in the side of a central gun housing midway of the housing for injecting the powder-air mixture into a chamber, as shown in FIG. 1*b*. A pointed needle or charge pin is connected to a high voltage generator which typically imparts a negative potential to the electrode. An electric field is established between the needle electrode and the grounded work-piece, with an intensified electric field located at the needle tip due to its small radius of curvature. When a combination of needle geometry and potential is sufficient to create a local electric field strength of 3 MV/m or higher, electrical breakdown of the air, or corona discharge, occurs in a region around the electrode tip. As a result of the local discharge, the air will be ionized, producing negatively charged ions. Powder particles carried by compressed air are transported along the conduit and pass through a discharge region, picking up negative ions on their way to the work-piece.

Corona charge guns, although are widely used in the coating industry, suffer from problems such as Faraday cage effect and back ionization. It would be desirable to provide an apparatus for dispensing powders while avoiding or minimizing the Faraday cage effect and back ionization. When workpieces with a convex geometry have to be coated by corona guns, the presence of an electric field between the gun tip and the work-piece generates a very serious problem, namely poor powder coverage in recessed areas coupled with excessive building up of powder in areas of boundaries or edges. This is a direct result of classical electrostatics, namely, less or no electric field lines can exist or penetrate areas which are surrounded by a grounded metal boundary. If air velocity is low, particles will follow a field line pattern that does not penetrate into an inside of a recessed or concave area of a work-piece. As a general rule, electrostatic forces will deposit material into an opening to a depth equal to or less than a smallest dimension of the opening. This is known as the Faraday cage effect. To a certain extent, a higher air velocity will help by "pushing" a powder into recessed or concave areas but this does not compensate for poor uniformity of coverage.

To eliminate or significantly reduce problems caused by the Faraday cage effect, alternative configurations of corona charge guns have been proposed and/or patented. Included in these are internal charging guns which charge the powder internally in the gun barrel before the powder is ejected from a gun outlet. Since there are no electrical lines built up between the gun nozzle and the grounded work-piece, the Faraday cage effect is eliminated. It is noted that given that the charged powder coming out of the gun tip also generates electrical potential, there may exist a weak electrical field between the gun tip and the work-piece, but such an effect is negligible. As referred to by Moyle, B. D. and Hughes, J. F. (*Electrostatics,* 16, 277, 1985), an internal charging gun comprises a duct in which a corona discharge needle electrode is located, an grounded ring electrode surrounding the tip of the corona needle or located downstream of the needle, as indicated in FIG. 1*c*. All powder emanating from the gun nozzle will pass through the corona discharge region surrounding the needle tip and charging is imparted to the powder in this region. Free ions not captured by the powder will be attracted to the surface of the grounded counter electrodes so that few of them are ejected from the nozzle. The result is a high specific charge with a fairly small voltage on a corona electrode, an electrical line free space between the gun nozzle and work-piece, and a large reduction of free ion emission towards the work-piece.

As stated by Moyle, B. D. and Hughes, J. F. (*Electrostatics,* 16, 277, 1985), although remarkably good in terms of high-quality coatings, long-term tests with the prior art internal charging corona guns have shown deterioration in performance after long uninterrupted runs. This is considered to be associated with a growth of partially cured powder and back-ionization on a ground counter electrode inside the gun. The inventors have conducted tests showing that with this configuration of electrodes, the ground counter electrode is coated by powder and becomes back-ionized within a few seconds to a few minutes. Powder deposition results in a significant deterioration of the charging performance leading to a degradation and failure of the gun. Thus, frequent cleaning of the gun must be performed with utmost care. This is a time consuming operation which normally requires shutdown of a production line.

Considerable efforts have been made to improve long-term efficiency of internal charging guns. Two different approaches involving a piezo-electric ceramic ring electrode which undergoes an oscillatory deformation and a curtain electrode with a double helix configuration have been considered as a solution to the problem (Moyle, B. D. and Hughes, J. F., *Electrostatics,* 16, 277, 1985; Masuda, S. *IEEE/IAS* Conference Proceedings 35D, 1977, P. 887). However, as mentioned by Misev, T. A. (Powder Coatings Chemistry and Technology, John Wiley & Sons, 1990), despite the promising results, neither attempt resulted in a commercial gun system. Another alternative is to employ a porous metal ring electrode which is cleaned by air purge (Misev, T. A., Powder Coatings Chemistry and Technology, John Wiley & Sons, 1990) to remove powder coated on a ring surface. Again, this design found no wide application as the ring surface can not be thoroughly cleaned because of the nature of the porous surface.

A recent improvement to the internal charging gun has been made by Muhlhausen, B. G. and Heidelberg, H-G. N. etc., ABB Research Ltd., Zurich, Switzerland and is disclosed in U.S. Pat. No. 6,254,684B1 (continuation of PCT/EP96/05462, or WO98/245555). This design includes a chamber, several high-voltage electrodes annularly distributed in a region upstream of the outlet and a tubular ground electrode extending along the cylindrical axis of the chamber at the back of the gun housing. The tubular ground electrode has an end directed towards an interior of the chamber and is covered by an insulating material with a small hole through which the tubular ground electrode is exposed to the high-voltage electrodes. The purpose of this configuration is to prevent the charged powder from depositing on the ground counter electrode because the ground counter electrode is located upstream of the high-voltage electrodes and is also continuously flushed by clean air. However, this design suffers from two drawbacks. First, the area of the ground electrode exposed to the high-voltage electrodes is very small which can result in dangerous sparking during operation. Secondly, due to the small area of the exposed ground electrode, the intensity of electrical field at the high-voltage electrode may not reach sufficiently high strengths to generate enough free ions that charge the powder effectively.

German Patent No. 27 22 100 B1 also describes a spray gun having a blunt ground electrode in a section of the gun barrel having an enlarged diameter located upstream of the charging pin and centrally located in the flow passageway. The purpose of having the ground electrode with a blunt shape in the enlarged cross-sectional area is to cause powder flow to slow to allow time for powder charging. However, the inventors have conducted tests on such configurations which have shown that this structure results in a highly irregular passageway for the powder and causes a surface of the blunt ground electrode, especially the side facing the high voltage electrode, to be coated almost immediately, leading to performance failure of the gun.

It would be very advantageous to provide a powder spraying apparatus which overcomes the aforementioned disadvantages of the above designs that provides long-term efficient charging performance and with a relatively simple configuration.

SUMMARY OF INVENTION

In one aspect of the invention there is provided an apparatus for spraying powders which includes a housing having first and second opposed ends defining a chamber terminating in an outlet passageway at a first end of the housing. A high voltage electrode is positioned in the chamber spaced upstream of the outlet passageway. The high voltage electrode includes at least one charging pin connected to a conductor located in an electrically insulated tube disposed along an axis of the housing, the conductor being connectable to a power supply for applying high voltages to the at least one charging pin. A ground electrode is positioned in the chamber spaced upstream from the high voltage electrode and the ground electrode has a surface area sufficiently larger than a surface area of the high voltage electrode in order to allow high voltages to be applied to the high voltage electrode without arch discharging occurring in the chamber. Also an inlet opening into the chamber is provided at the second end of the housing for conducting a powder-gas mixture into the chamber. The high voltage electrode receives a gas for avoiding powder deposits on the high voltage electrode. The chamber defines an inner cylindrical surface and the ground surface electrode is a cylindrical electrode having an outer diameter such that the cylindrical electrode is substantially concentric with the inner cylindrical surface, the cylindrical electrode having an inner surface which has the second conducting surface area that is sufficiently larger than the first surface area of the high voltage pin electrode.

In another aspect of the invention, there is provided an apparatus for spraying powders including a housing having first and second opposed ends and a housing wall defining a chamber terminating in an outlet passageway at the first end of the housing. A high voltage electrode is mounted in the chamber spaced upstream of the outlet passageway. A ground electrode is mounted in the chamber spaced upstream from the high voltage electrode and has a surface area sufficiently larger than a surface area of the high voltage electrode in order to allow high voltages to be applied to the high voltage electrode without arch discharging occurring in the chamber. Also an inlet opening into the chamber is at a position in the housing wall located between the ground electrode and the high voltage electrode for conducting the mixture of gas and powder particles into the chamber where the powder particles acquire a charge as they move downstream between said inlet and said high voltage electrode to be ejected from the chamber through the outlet passageway. Further, the ground electrode and the high voltage electrode receive air for avoiding powder deposits on the ground electrode and the high voltage electrode.

BRIEF DESCRIPTION OF DRAWINGS

The following is a description, by way of example only, of embodiments of an apparatus for dispensing powder coatings constructed in accordance with the present invention, reference being had to the accompanying drawings, in which.

DETAILED DESCRIPTION OF THE INVENTION

Figure 2:
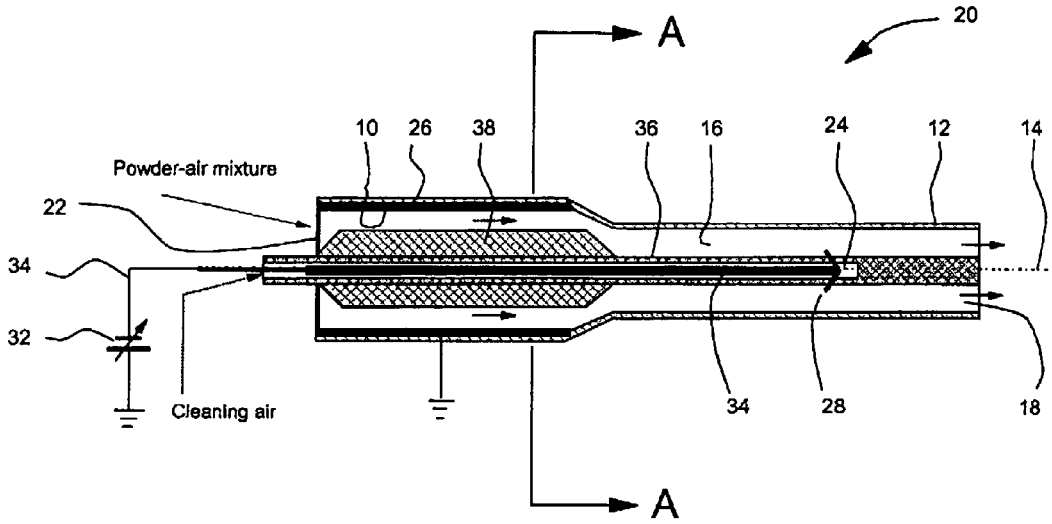
FIG. 2 is a cross sectional view of an apparatus for dispensing powders constructed in accordance with the present invention.

Referring to FIG. 2, an apparatus for dispensing powders is shown at 20 which comprises an elongate housing 12 made of an insulating material such as plastic. Housing 12 has a longitudinal axis 14 and defines a chamber 16 terminating in an outlet passageway 18 from which a mixture of gas and powder particles is expelled. A supply conduit opening or inlet 22 for introducing a powder-air mixture into the chamber 16 is located at an opposing end of housing 12. A high voltage pin electrode 24 is spaced upstream of the outlet passageway 18, a short distance, and a ground surface electrode 10 is located further upstream of high voltage pin electrode 24. The high voltage pin electrode 24 includes one or more charging pins 28 with the electrode aligned along the longitudinal axis 14 of housing 12.

Figure 2A:
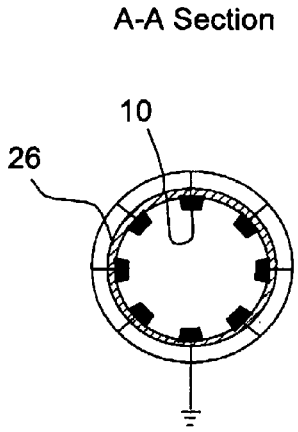
FIG. 2*a* a cross sectional view of FIG. 2 showing the ground electrode sections being jointly grounded.
Figure 2B:
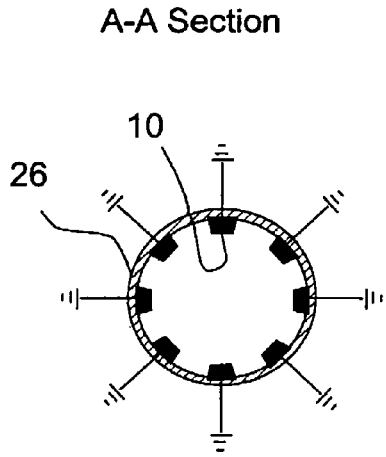
FIG. 2*b* is a cross sectional view of FIG. 2 showing the ground electrode sections being separately grounded.

The ground electrode 10, which is spaced upstream from the high voltage electrode 24, is preferably cylindrical. The chamber 16 defines an inner cylindrical surface and the ground electrode 10 has an outer diameter such that an outer surface of the cylindrical electrode 10 bears against the inner cylindrical surface of chamber 16. The ground electrode 10 can also be several pieces forming sections of the cylindrical surface, each being separately (FIG. 2*b*) or jointly (FIG. 2*a*) grounded. The ground electrode 10 has an inner surface having a surface area that is much larger than a surface area of the high voltage electrode 24. A cylindrical body 38 is located along the axis 14 in the section of the housing 12 containing the ground electrode 10. The cylindrical body 38 is made of an electric insulating material and serves the purpose of accelerating the powder flow so as to keep the ground electrode 10 from being coated with powder. The body 38 reduces the effective open cross sectional area of the chamber 16 upstream of the high-voltage electrode 24, thus creating an increased flow velocity from the inlet 22 toward the high-voltage electrode of the powder-air mixture. A power supply 32 is connected to electrode 24 by a wire 34 running through an insulated tube 36 which extends along axis 14 of the housing 12. Section 26 of housing 12 containing the ground electrode 10 may optionally be made to have a larger or smaller diameter than the rest of the housing 12 to optimize flow of the powder-air mixture so as to provide an appropriate velocity and turbulence for best cleaning of the ground electrode 10.

Figure 1A:
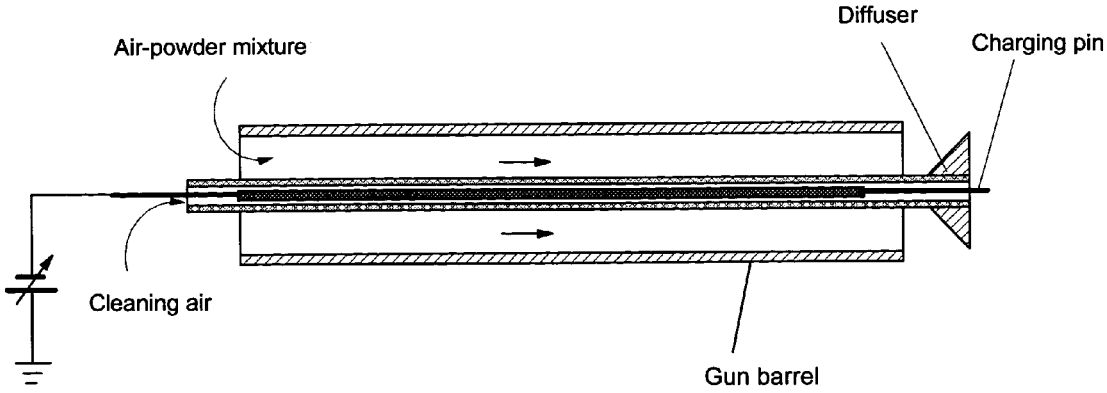
Prior Art Figure 1a
FIG. 1*a* is a cross sectional view of a Prior Art corona charge gun for dispensing powders.
Figure 1B:
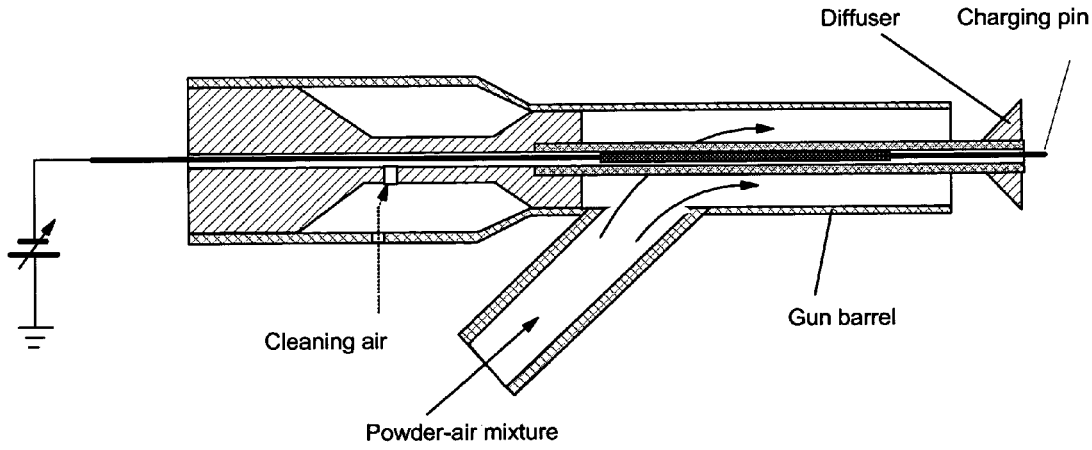
Prior Art Figure 1b
FIG. 1*b* is a cross sectional view of another Prior Art corona charge gun for dispensing powders.
Figure 1C:
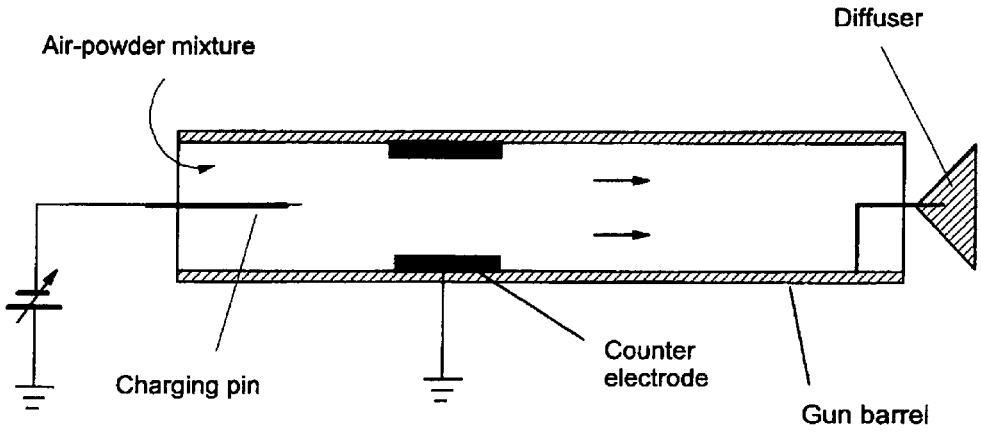
Prior Art Figure 1c
FIG. 1*c* is a cross sectional view of another Prior Art internal charging gun for dispensing powders.

In operation, a high negative voltage is applied to high voltage electrode 24 by a power supply 32. Cleaning air flows into tube 36 to keep powder from caking on electrode 24. In this embodiment of spray gun 20, the ground electrode 10 is placed up-stream of the high-voltage electrode 24 in the barrel or housing 12. This differs from some conventional configurations where the ground electrode is placed either down-stream of the high voltage electrode, or in the same axial position as the high voltage electrode (see FIG. 1*c*). With the electrode embodiments disclosed herein, an electrical field will be established between the down-stream high-voltage charging electrode 24 and the ground electrode 10 and a charging zone, primarily surrounding the high voltage electrode 24, will be formed because of the more concentrated electrical field lines in this region due to a much smaller surface area of the high voltage electrode compared to the ground electrode.

When powder passes through the cylindrical electrode 10, it is in a neutral state because it has not passed the charging zone and thus the powder will not cling to the ground electrode 10. On the other hand, free ions created at the high voltage charging electrode 24 flowing counter currently with the powder-air mixture towards the cylindrical electrode, lead to an enhanced mixing with powder, thus creating a much higher charge transfer efficiency to the powder and a reduced back ionization on the surface of ground electrode 10, thereby mitigating deterioration in charging performance over long-term operation.

For a corona charge gun, a high efficiency of ionization of air at the high voltage charging electrode is preferred, so as to provide adequate charge to the powder. This requires an intense electrical field at the high voltage electrode created by a high enough voltage. In the present invention, a ground electrode with a large surface area is employed to make a pin-to-surface configuration. This ensures a localized high density electric field in a space adjacent to the pin tip and in turn an efficient ionization of air molecules. Equation 1 (Technical Handbook for Electrostatic Discharge Protection, Zhang, B. M. et al., Electronics Industry Press, Beijing 2000) can be used to estimate the breakdown voltage of air, $V_b$ (KV), for a negative pin to grounded flat surface configuration:

$$V_b=100+8.6d \tag{1}$$

where d (cm) is the distance between the pin and the flat surface. When a negatively charged high voltage pin is, for example, 5 cm away from the ground electrode, it needs 143 KV of voltage to break through air between the pin and the ground electrode. In other words, the voltage of the pin can go as high as 143 KV without occurrence of sparking. A pin-to-pin arrangement, however, allows a much smaller voltage difference between the charging pin and the grounded pin, so that the ionization efficiency of air is highly limited by the low voltage. This is because the intensive field lines between two pin points will cause the air to break down and produce dangerous sparks as soon as a minimum breakdown intensity of electrical field, estimated by Equation 2 (Technical Handbook for Electrostatic Discharge Protection, Zhang, B. M. et al., Electronics Industry Press, Beijing 2000), is reached:

$$V_b=5.2d \tag{2}$$

where d (cm) is the distance between the charging pin and the grounded pin. If the two pins are set to 5 cm apart, for example, only 26 KV is needed for the breakdown of air, which is more than 5 times lower than that of a pin-to-surface arrangement.

Therefore, for the pin-to-surface configuration, as employed in this invention, a much higher voltage can be imparted to the charging pin without causing sparks, because the intensity of field lines upon the surface of the ground electrode is low enough to prevent arc discharging or air breakdown near the ground electrode and further prevent powder curing on the ground electrode. For this reason, this invention significantly enhances the powder charging efficiency compared with the pin-to-pin arrangement patented by Muhlhausen, B. G. and Heidelberg, H-G. N. et al., ABB Research Ltd., Zurrich, Switzerland (U.S. Pat. No. 6,254,684B1, 2001, continuation of PCT/EP96/05462, or WO98/245555). Tests conducted by the inventors have shown that with the pin-to-pin embodiments of the prior art, the sparking voltage is quickly reached, while with the pin-to-surface embodiment of the apparatus of the present invention shown at 20 in FIG. 2, a sparking voltage was found to be several times higher. This invention also prevents powder curing compared with the pin-to-pin arrangement.

Figure 3:
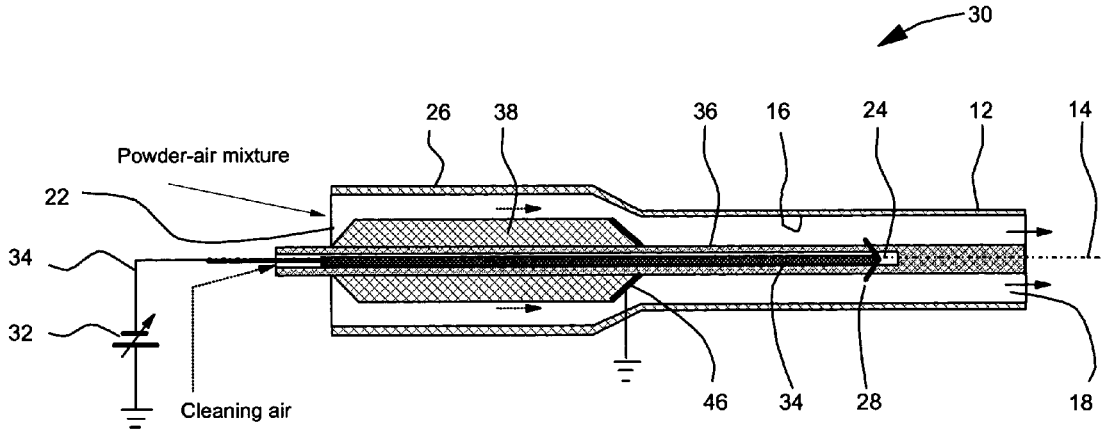
FIG. 3 is a cross sectional view of an alternative embodiment of an apparatus for dispensing powders having a cone-shape ground electrode.

Referring to FIG. 3, an embodiment of an alternative powder spray apparatus is shown at 30 in which a ground electrode 46 is a conductor located on a conical shaped surface located at the downstream end of cylindrical body 38. This position is preferred over other places of cylindrical body 38 because the high turbulent powder-air flow at this region has a very significant cleaning effect on the ground electrode thereby preventing buildup of powders on the ground electrode surface. Based on the discussion above, special care should be taken to ensure there exist no sharp points on the surface or exposed sharp edges of electrode 46 in order to prevent points of concentration for the electric field lines resulting in arc discharging.

Figure 3A:
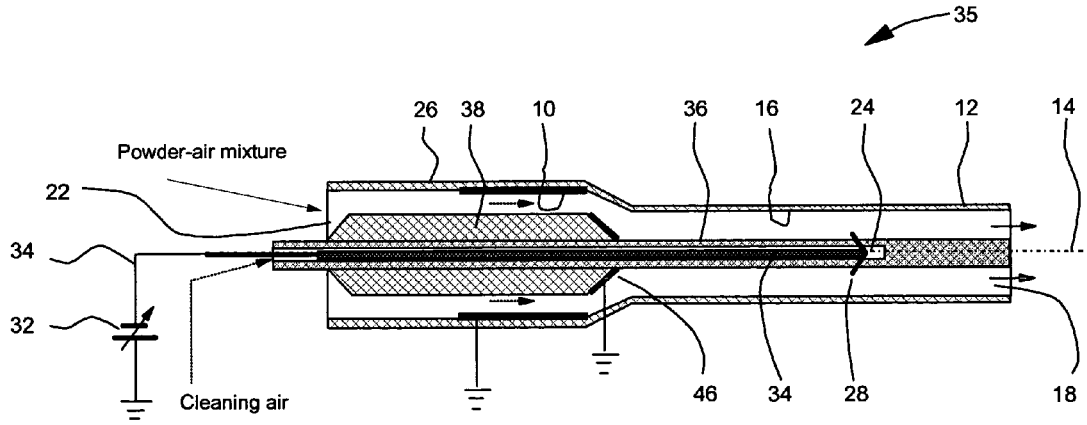
FIG. 3*a* is a cross sectional view of another embodiment of an apparatus for dispensing powders which combines features of the embodiments shown in FIGS. 2 and 3.

FIG. 3*a* shows another embodiment of a powder spray gun apparatus at 35 which is similar to the embodiment shown in FIG. 3 but with an additional ground cylindrical electrode 10 located at the same position as the grounded electrode in FIG. 2, at the inner surface of the section 26.

Figure 4:
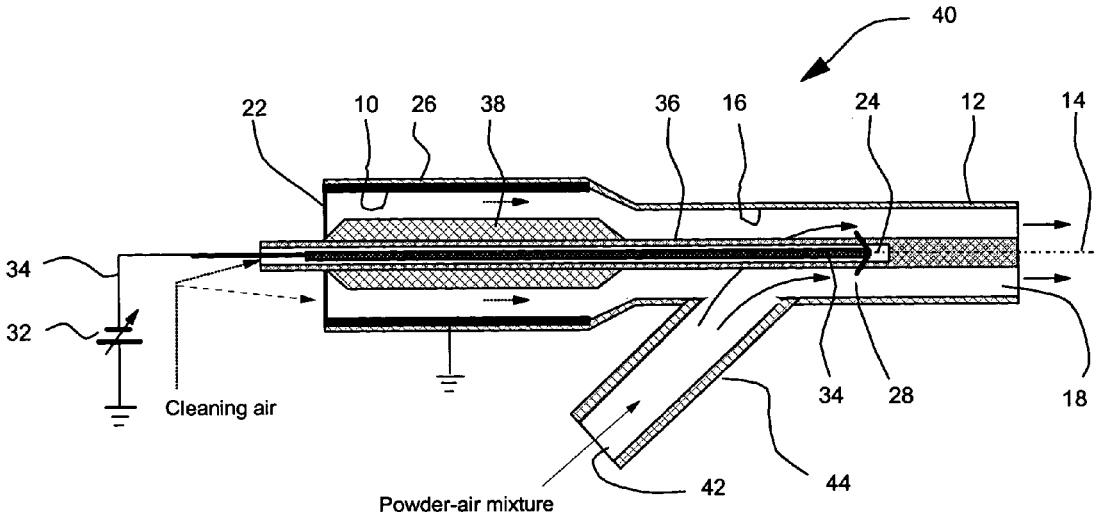
FIG. 4 is a cross sectional view of another embodiment of an apparatus for dispensing powders with a powder inlet located between a ground electrode and a high voltage electrode.

An alternative embodiment of a powder spray apparatus is shown in FIG. 4 at 40. In apparatus 40, a conduit 44 defines a powder-air inlet 42 opening into chamber 16 for conducting the mixture of gas and powder particles into chamber 16, located at a position in the wall of housing 12 between the ground electrode 10 and the high voltage electrode 24. In this configuration the powder does not pass directly over ground electrode 10 and the powder particles acquire a charge as they move downstream between inlet 42 and the high voltage electrode 24 in chamber 16. This arrangement further ensures that a clean ground electrode 10 is maintained. The cleaning air enters chamber 16 through the inlet 22 located at the back end of housing 12 with the direction of air flow indicated by the arrows. The air flowing through cylindrical ground electrode 10 helps prevent powder buildup on the ground electrode and mixes with the powder/gas mixture entering chamber 16 from inlet 42 downstream of electrode 10. In addition, cleaning air flows into tube 36 from the back end thereof located at the back end of the housing 12 with the direction of air flow indicated by the arrows with the air flow acting to keep powder from caking on electrode 24.

Figure 4A:
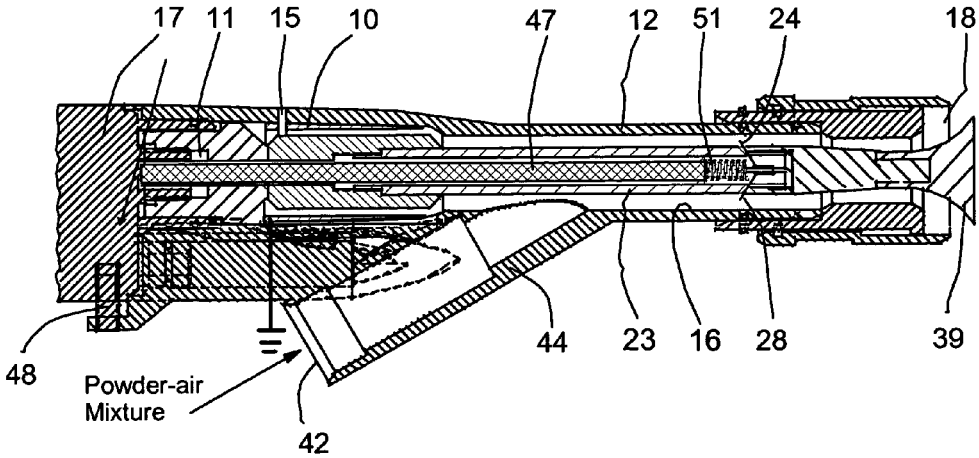
FIG. 4*a* is a cross sectional view of an embodiment of an apparatus for dispensing powders similar to the embodiment shown in FIG. 4.

FIG. 4*a* shows the details of an embodiment of a powder discharge apparatus similar to the embodiment shown in FIG. 4. Housing or gun barrel 12 snaps onto a gun base 17 and is locked by a plastic screw 48. An electrically conductive rod 47 is located inside an insulated tube 23 running along the longitudinal axis of housing 12. The conductive rod 47 connects the high voltage from the gun base to the high voltage electrode 24 and the charging pins 28 through a metal spring 51. Ground electrode 10 is grounded so that an electric field will be established between the charging pins and the ground electrode. Conduit 44 is a powder-air mixture conduit with an inlet at 42. When powder particles enter chamber 16 through conduit 44, the particles are charged and then sprayed out of the end 18 of the housing 12 and are dispersed by the diffuser 39 mounted at the end of housing 12. Cleaning air entering chamber 16 through air inlet 11 and the insulated tube 23 cleans the charging pins 28. The ground electrode 10 is kept clean by another stream of cleaning air coming in through inlet 15 at high air velocity through the section of the housing containing the ground electrode.

Figure 5:
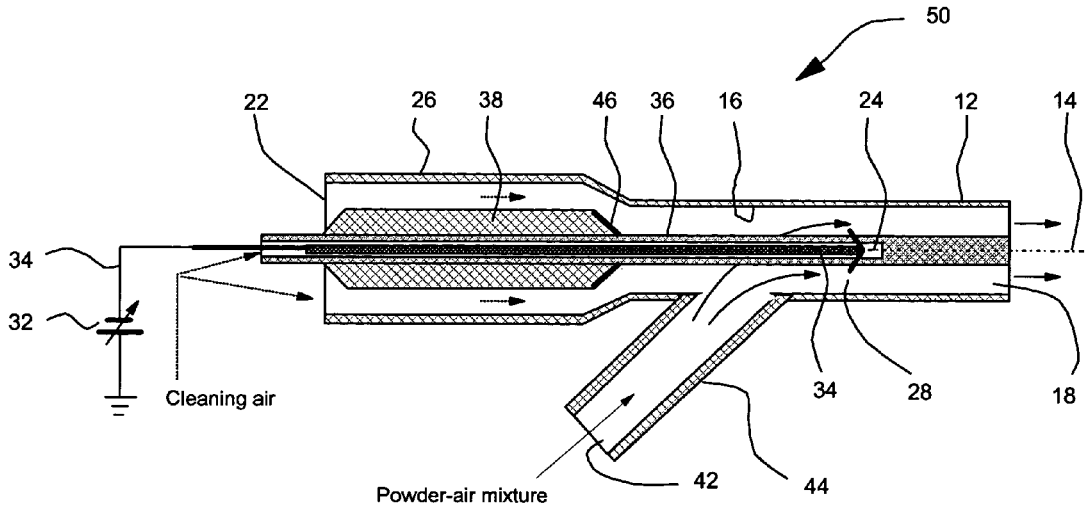
FIG. 5 is a cross sectional view of yet another alternative embodiment of an apparatus for dispensing powders having a cone-shape ground electrode coupled with the side powder-air inlet configuration of FIG. 4.

With the powder/gas inlet 42 being located between the high voltage electrode and the ground electrode 10, as shown in FIG. 4, the ground electrode 10 may be of any shape. For example, referring to FIG. 5, another embodiment of a powder spray apparatus is shown at 50 having a ground electrode 46 with a conical shape symmetric about the axis 14 of housing 12 and located at the downstream end of the cylindrical body 38.

Figure 6:
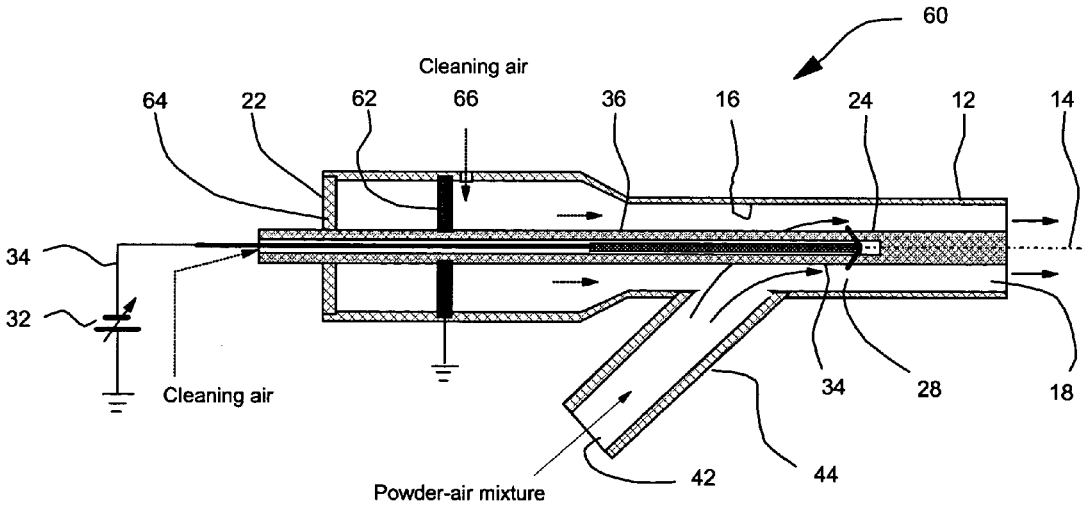
FIG. 6 is a cross sectional view of another alternative embodiment of an apparatus for dispensing powders having a planar ground electrode.

In addition, referring to FIG. 6, another embodiment of the spray apparatus shown generally at 60 is similar to apparatus 40 but instead of using a cylindrical ground electrode 10 as in apparatus 40, a flat planar ground electrode 62 is used with special care taken to ensure there are no exposed sharp edges or sharp points on the surface of ground electrode 62 in order to prevent points of concentration for electric field lines, resulting in arc discharging.

In this embodiment of the invention, since the chamber 16 is a cylindrical chamber having a circular cross section, ground electrode 62 is a circular electrode having a planar surface and a radius equal to a radius of the circular cross section of the chamber 16 and is disposed in the chamber so that the planar surface is perpendicular to the cylindrical axis, and again, the ground electrode has a surface area that is sufficiently larger than the surface area of the high voltage electrode 24 to permit high voltages to be applied to electrode 24. Housing 12 is sealed by a plate 64 at the back end 22 of housing 12 while the other end 18 of housing 12 is the outlet similar to the embodiments shown in FIGS. 2 and 4. The cleaning air used to clean ground electrode 62 enters chamber 16 downstream of electrode 62 through one or more air inlet(s) 66 located in the wall of housing 12 and the flow of the air and powder-gas mixture is indicated by the arrows. Cleaning air for high voltage electrode 24 is also introduced into the entrance of tube 36 located at the back end of housing 12.

Figure 7:
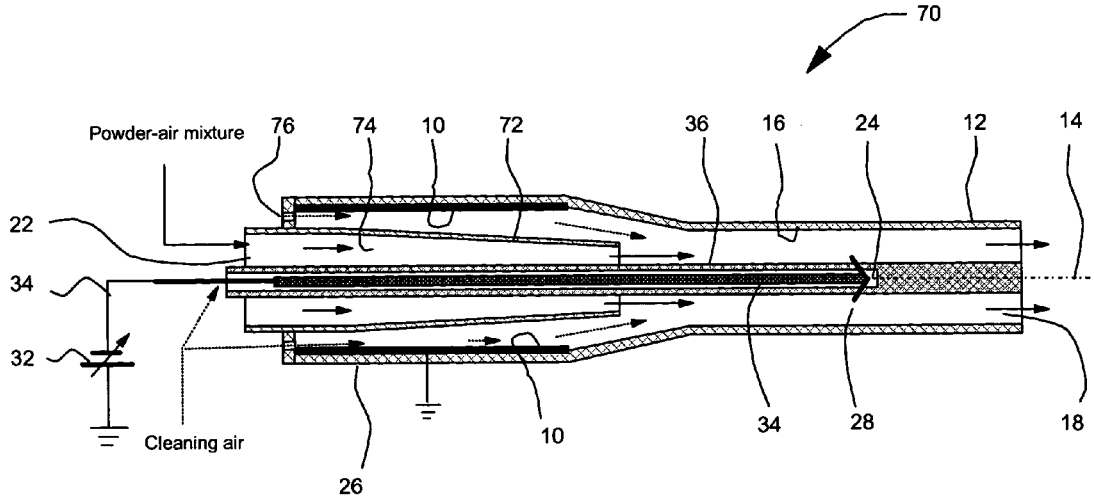
FIG. 7 is a cross sectional view of another alternative embodiment of an apparatus for dispensing powders having an internal barrel configuration for shielding a ground electrode from powder buildup.

Referring to FIG. 7, another alternative embodiment of an apparatus for spraying powders is shown generally at 70. Apparatus 70 is similar in structure to apparatus 20 shown in FIG. 2 but includes a tapered tube 72 made of insulating material aligned around the axis 14 of housing 12 and concentric on the inside of cylindrical ground electrode 10 defining a powder/gas passageway 74 located between the tube 36 and tapered tube 72 so that ground electrode 10 is shielded from the powder flow. The cleaning air flow is directed down tube 36 and through holes 76 which are located at the back end of housing 12 and in the annular region between tapered tube 72 and the outer section 26 of housing 12 (as indicated by the arrows in FIG. 7) whereupon the air or gas flow passes through cylindrical ground electrode 10 to help prevent powder buildup on the ground electrode 10 and mixes with the powder-air mixture downstream of tube 72. The powder-air mixture enters inlet 22 and into passageway 74.

Figure 7A:
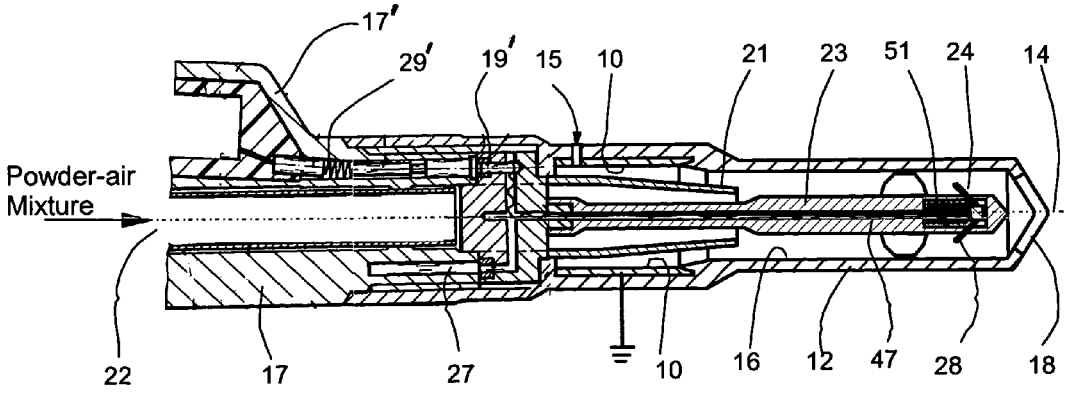
FIG. 7*a* is a cross sectional view showing details of an embodiment of an apparatus for dispensing powders similar to the embodiment shown in FIG. 7.

FIG. 7*a* shows a more detailed view of an embodiment similar to the embodiment 70 shown in FIG. 7. Housing 12 is threaded onto a base 17'. Inside the housing 12 and extending along chamber 16 in the section containing the ground electrode is a tube 21 connected to the powder-air conduit which in turn has an inlet at 22. Tube 21 guides the powder-air mixture through the section where the ground bushing 10 is and thus shields the bushing from being coated by powder. A metal spring 29' connects the high voltage from the base 17 to the pin-type connector 19' which carries the high voltage to the electrode 24 and charging pins 28 through a wire, an electrically conductive rod 47 and the metal spring 51 located inside the insulated tube 23. Powder particles are charged between the downstream end of tube 21 and the charging pins 28 and are sprayed out of the end 18 of the gun barrel. Cleaning air entering through inlet 15 prevents powder from moving backwards upstream so as to ensue the ground electrode 10 is not coated with powder. Cleaning air entering tube 23 through air inlet 27 flushes the tube 23 and cleans the charging pins 28.

Figure 8:
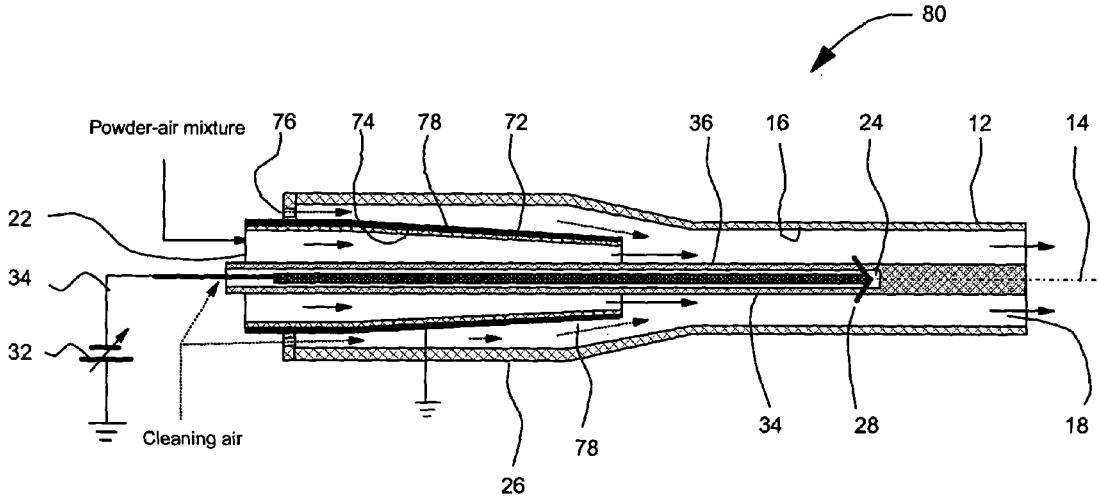
FIG. 8 shows yet another alternative embodiment of an apparatus for dispensing powders having an internal barrel configuration for shielding a ground electrode from powder buildup.

Referring to FIG. 8, an alternative embodiment of a powder spray gun is shown generally at 80. Apparatus 80 is very similar to embodiment 70 shown in FIG. 7, but in apparatus 80 the ground electrode 78 is located on the outer surface of the insulating tapered tube 72, instead of the inner surface of the outer gun barrel as shown at 10 in FIG. 7.

Alternatively, the internal barrel 72 may itself be used as the ground electrode if it is made from conducting material. In this alternative embodiment, it is noted that the fact that the ground electrode has two conducting surfaces will not significantly affect the functionality of the ground electrode because the outer surface of tapered tube 72 is the most effective surface for charging.

Figure 9:
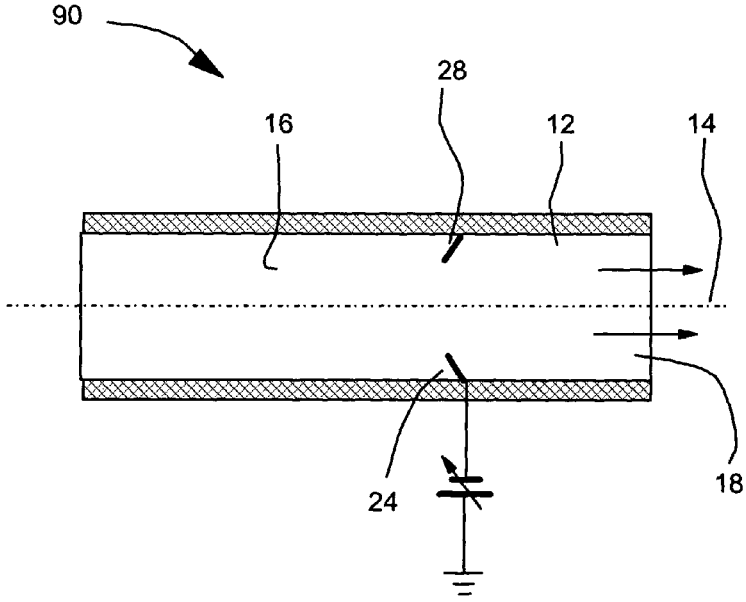
FIG. 9 shows a portion of an apparatus for dispensing powders in which a high voltage electrode is located on a wall of the housing.

It will be understood by those skilled in the art that although the high voltage electrode 24 is shown to be located along the axis of the gun barrel in the devices shown in FIGS. 2-8, it may also be placed at other places in the section of chamber 16 near the first end of the housing 12, downstream of the ground electrode and the powder inlet and upstream of outlet passageway 18. FIG. 9 shows a specific embodiment where the high voltage electrode 24 with multiple pins 28 are spaced along the inner surface of the housing 12. These pins 28 are all connected to the same or separate high voltage source.

It should also be mentioned that although the ground electrode is shown as a complete cylindrical piece in FIGS. 2, 4, 7 and 8, it can also be of sections of a metallic cylinder that are grounded either jointly or separately to act, in whole, as a cylindrical piece.

The internal corona-charging powder dispensing guns disclosed herein are useful for a large number of applications in the powder coating industry. The most significant advantage is that they largely eliminate the Faraday cage effect found in coating work-pieces with recessed areas. The present powder dispensing devices disclosed herein can also maintain long-term optimum performance without frequent manual cleaning, as required by the prior art of internal charging guns. This enhances coating quality, reduces powder consumption and labor costs, and increases the productivity of existing coating lines, especially for parts with recessed areas.

When flat surfaces are being coated using the devices of the present invention, the powder transfer efficiency is increased due to the fact that less free ions are ejected out of the outlet 18 resulting in less back ionization at the surface of the part being coated. Furthermore, fat edge effects will also be eliminated due to the absence of an external electrical field with the present invention.

This invention can also be applied to other areas where air needs to be ionized or powder form materials need to be corona-charged. For instance, the devices disclosed herein may be used in electrostatic dust collectors, air cleaners, ion generators and the like.

Differences between the present spray devices and that disclosed in German Patent No. 27 22 100 B1 include the fact that the role of the ground electrode disclosed in German Patent No. 27 22 100 B1 is to decrease the powder flow rate and to induce turbulent flow in the chamber while, in the present invention, the ground electrode is positioned to contribute to acceleration of the flow of the powder-air mixture. The German device uses an undulating geometry to provide greater turbulence and longer residence for the powder so as to increase probability of charging. However, the wakes produced behind the ground electrode(s) make it much easier for the powder to deposit on the surface(s) of the ground electrode(s), due to the low velocity of the powder/air mixture. Also, for the same reason, the ion wind driven by the electrical field between the high voltage electrode and the ground counter-electrode will push the powder particles to move backwards and impact on the surface of the ground electrode facing the charging pin which causes impact fusing and curing of paint. By contrast, in the present invention, the accelerated powder-air flow over the surface of the ground electrode prevents the powder particles from being pushed backwards so that impact fusing and curing are avoided.

Another advantage of the present invention is a reduction of curing at the counter or ground electrode due to the lower intensity electric fields surrounding the surface of the counter electrode. In pin-to-pin configurations, curing at the counter electrode may be problematic, which is avoided with the present invention.

It will be appreciated that while the cleaning gas and the gas used to produce the gas-powder mixture has been disclosed as air, other inert gases may be used, for example, nitrogen. In addition, while the different embodiments of the powder dispensing devices as disclosed herein have used cylindrical housings with circular cross sections, it will be understood that the principles disclosed herein are not in any way limited to housings with circular cross sections and housings with other cross-sectional shapes, including square and rectangular, may also be used.

As used herein, the terms "comprises", "comprising", "including" and "includes" are to be construed as being inclusive and open ended, and not exclusive. Specifically, when used in this specification including claims, the terms "comprises", "comprising", "including" and "includes" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A corona discharge apparatus for spraying powders, comprising:

a) a housing having first and second opposed ends, the housing defining a chamber terminating in an outlet passageway at said first end of the housing;

b) a high voltage pin electrode positioned in the chamber spaced upstream of the outlet passageway, the high voltage pin electrode having a first surface area, and including at least one charging pin connected to a conductor located in an electrically insulated tube disposed along an axis of the housing, the conductor being connectable to a power supply for applying high voltages to the at least one charging pin;

c) a ground surface electrode positioned in the chamber spaced upstream from the high voltage pin electrode, the ground surface electrode having a second conducting surface area that is sufficiently larger than the first surface area of said high voltage pin electrode to give a pin-to-surface electrode configuration such that when a high voltage is applied to the high voltage pin electrode, an electrical field produced in a vicinity of the ground surface electrode is sufficiently low to prevent arc discharging occurring in the vicinity of the ground surface electrode in the chamber;

d) an inlet opening into the chamber for conducting a powder-gas mixture into the chamber, said inlet opening being located at the second end of the housing; and e) means for supplying a cleaning gas toward the high voltage pin electrode to reduce powder deposits on the high voltage pin electrode, wherein the chamber defines an inner cylindrical surface and the ground surface electrode is a cylindrical electrode having an outer diameter such that the cylindrical electrode is substantially concentric with the inner cylindrical surface, the cylindrical electrode having an inner surface which has the second conducting surface area that is sufficiently larger than the first surface area of the high voltage pin electrode.

2. The apparatus according to claim 1 wherein the means for supplying a cleaning gas to reduce powder deposits on the high voltage pin electrode includes the electrically insulated tube.

3. A corona discharge apparatus for spraying powders, comprising:

a) a housing having first and second opposed ends, the housing defining a chamber terminating in an outlet passageway at said first end of the housing;

b) a high voltage pin electrode positioned in the chamber spaced upstream of the outlet passageway, the high voltage pin electrode having a first surface area, and including at least one charging pin connected to a conductor located in an electrically insulated tube disposed along an axis of the housing, the conductor being connectable to a power supply for applying high voltages to the at least one charging pin;

c) a ground surface electrode positioned in the chamber spaced upstream from the high voltage pin electrode, the ground surface electrode having a second conducting surface area that is sufficiently larger than the first surface area of said high voltage pin electrode to give a pin-to-surface electrode configuration such that when a high voltage is applied to the high voltage pin electrode, an electrical field produced in a vicinity of the ground surface electrode is sufficiently low to prevent arc discharging occurring in the vicinity of the ground surface electrode in the chamber;

d) an inlet opening into the chamber for conducting a powder-gas mixture into the chamber, said inlet opening being located at the second end of the housing; and e) means for supplying a cleaning gas toward the high voltage pin electrode to reduce powder deposits on the high voltage pin electrode, wherein the chamber defines an inner cylindrical surface and the ground surface electrode includes a plurality of sections of a cylindrical electrode mounted around the inner cylindrical surface with each section being separately or jointly grounded, the sections of the cylindrical electrode having inner surfaces which cumulatively define the second conducting surface area that is sufficiently larger than the first surface area of the high voltage pin electrode.

4. The apparatus according to claim 1 wherein a first section of the chamber upstream of the high voltage pin electrode containing the ground surface electrode has a cross sectional area which is less than that of a second section of the housing containing the high voltage pin electrode in order to increase a velocity of the powder-gas mixture flow within the first section and to create turbulence in order to keep the ground surface electrode from being coated by powder.

5. The apparatus according to claim 1 wherein a first section of the chamber upstream of the high voltage pin electrode containing the ground surface electrode includes an insulated cylindrical member disposed symmetrically along the axis of the housing for narrowing the chamber in the first section in order to increase a velocity of the powder-gas flow and to create turbulence in order to keep the ground surface electrode from being coated by powder.

6. The apparatus according to claim 5 wherein the housing has a portion surrounding the insulated cylindrical member disposed symmetrically along the axis which has a radius which is larger than a radius of a portion of the housing surrounding the high voltage pin electrode.

7. The apparatus according to claim 5 wherein said insulated cylindrical member disposed symmetrically along the axis of the housing has a downstream end portion, and wherein the ground surface electrode includes an electrical conductor mounted on the downstream end portion so that electrical field lines are developed between the high voltage pin electrode and both the cylindrical electrode and the electrical conductor.

8. A corona discharge apparatus for spraying powders, comprising:

a) a housing having first and second opposed ends, the housing defining a chamber terminating in an outlet passageway at said first end of the housing;

b) a high voltage pin electrode positioned in the chamber spaced upstream of the outlet passageway, the high voltage pin electrode having a first surface area, and including at least one charging pin connected to a conductor located in an electrically insulated tube disposed along an axis of the housing, the conductor being connectable to a power supply for applying high voltages to the at least one charging pin;

c) a ground surface electrode positioned in the chamber spaced upstream from the high voltage pin electrode, the ground surface electrode having a second conducting surface area that is sufficiently larger than the first surface area of said high voltage pin electrode to give a pin-to-surface electrode configuration such that when a high voltage is applied to the high voltage pin electrode, an electrical field produced in a vicinity of the ground surface electrode is sufficiently low to prevent arc discharging occurring in the vicinity of the ground surface electrode in the chamber;

d) an inlet opening into the chamber for conducting a powder-gas mixture into the chamber, said inlet opening being located at the second end of the housing;

e) means for supplying a cleaning gas toward the high voltage pin electrode to reduce powder deposits on the high voltage pin electrode; and f) an insulated cylindrical member disposed symmetrically along the axis of the housing having a downstream end portion spaced upstream of the high voltage pin electrode, and wherein the ground surface electrode includes an electrical conductor mounted on the downstream end portion of insulated cylindrical member so that electrical field lines are developed between the high voltage pin electrode and the electrical conductor.

* * * * *